United States Patent [19]

Mushardt et al.

[11] Patent Number: 4,809,465

[45] Date of Patent: Mar. 7, 1989

[54] MOUNTING FOR ROTARY TOOLS

[75] Inventors: Heinrich Mushardt, Neu-Börnsen; Dieter Plähn, Escheburg, both of Fed. Rep. of Germany

[73] Assignee: Körber AG, Hamburg, Fed. Rep. of Germany

[21] Appl. No.: 130,399

[22] Filed: Dec. 9, 1987

[30] Foreign Application Priority Data

Dec. 10, 1986 [DE] Fed. Rep. of Germany ..... 3642111

[51] Int. Cl.[4] ..... B24B 45/00

[52] U.S. Cl. ..... 51/168; 51/166 R; 51/206 R; 83/666

[58] Field of Search ..... 51/168, 166 R, 206; 83/666

[56] References Cited

U.S. PATENT DOCUMENTS 4,731,955 3/1988 Henle ..... 51/168

*Primary Examiner*—Frederick R. Schmidt
*Assistant Examiner*—Maurina Rachuba
*Attorney, Agent, or Firm*—Peter K. Kontler

[57] ABSTRACT

A mounting for a grinding wheel serves to connect the grinding wheel to the tool spindle of a grinding machine has a holding member for the grinding wheel and a threaded fastener which separably secures the holding member to the spindle. The fastener is surrounded by an annular retaining portion of a tensioning device which has elastic prongs at one side and a compression spring at the other side of the retaining portion. The prongs are clamped between the holding member and the head of the fastener in response to rotation of the fastener in a direction to couple the holding member to the spindle, and the compression spring then reacts against the spindle so that the tensioning device maintains the fastener in form- and force-locking engagement with the holding device.

22 Claims, 1 Drawing Sheet

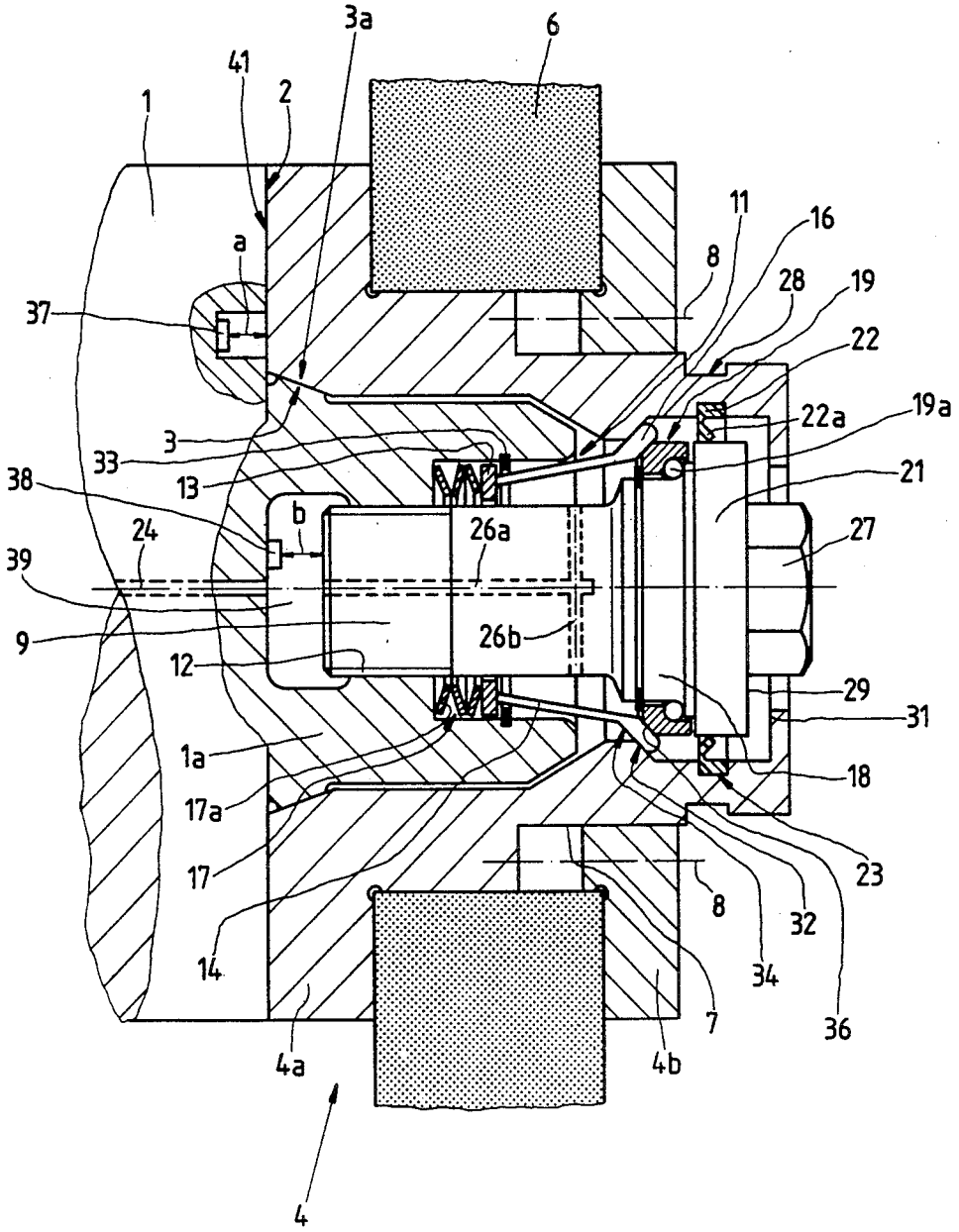
3a
6
41
2
1
11
16
a
8
28
19
37
22
22a
19a
3
33
21
13
38
b
26a
27
24
39
9
26b
12
29
31
1a
18
17a
23
17
8
32
14
34
7
36
4a
4b
4

MOUNTING FOR ROTARY TOOLS

CROSS-REFERENCE TO RELATED CASES

The mounting of the present invention constitutes an improvement over and a further development of devices which are disclosed in commonly owned U.S. Pat. No. 4,589,232, in commonly owned U.S. patent application Ser. No. 891,539 (now U.S. Pat. No. 4,731,955), in commonly owned German Utility Model No. G 84 14 854.3, and in commonly owned copending German patent application Ser. No. P 36 25 201.8.

BACKGROUND OF THE INVENTION

The invention relates to mountings for rotary material removing tools in grinding machines and in other types of machine tools, and more particularly to improvements in mountings of the type wherein a tool holding member is releasably affixed to a rotary supporting member, e.g., to a motor-driven spindle in a grinding machine. Still more particularly, the invention relates to improvements in mountings of the type wherein the means for coupling the holding member to the supporting member includes a threaded fastener which is coaxial with the supporting member.

A mounting of the class to which the present invention pertains is disclosed, for example, in commonly owned U.S. patent applicaton Ser. No. 891,539.

OBJECTS AND SUMMARY OF THE INVENTION

An object of the invention is to provide a simple, compact and inexpensive mounting which renders it possible to couple the tool holding member to the supportingmember with a variable force and which allows for automatic attachment of the holding member to or automatic separation of the holding member from the supporting member.

Another object of the invention is to provide a mountingwhich automatically centers the holding member on the supporting member when such members are properly coupled to each other and wherein the mutual positions of, as well as the magnitude of clamping forces acting between, the supporting and holding members can be monitored in a simple and efficient way.

A further object of the invention is to provide a mounting which can be used in existing machine tools as a superior substitute for heretofore known mountings.

An additional object of the invention is to provide a mounting wherein the transmission of tensional stresses between the fastener and the tool holding member takes place in a novel and improved way.

The invention resides in the provision of a mounting for rotary tools in a machine tool, particularly in a grinding machine. The mounting comprises a rotary supporting member (e.g., a spindle which is driven by an electric motor to rotate the tool), a rotary tool holding member (e.g., a composite flange having two sections which can clamp a grinding or other rotary tool between them), means for separably clamping or coupling the holding member to the supporting member so that the two members rotate as a unit including a threaded fastener which is coaxial with the supporting and holding members, and resilient tensioning means which is form- and force-lockingly installed between one of the holding and supporting members and the coupling or clamping means. In accordance with a presently preferred embodimentof the mounting, the fastener of the coupling or clamping means mates with the supporting member and the tensioning means is interposed between the fastener and the tool holding member. The tensioning means can concentrically surround the fastener and is preferably elastic in the axial and radial directions of the fastener.

In accordance with a presently preferred embodiment of the invention, the tensioning means comprises an annular retaining portion which surrounds the shank of the fastener, a plurality of radially movable elastic prongs or tongues at one side of the retaining portion, and a spring (preferably a compression spring) which is disposed at the other side of the annular retaining portion and is yieldable in the axial direction of the fastener. The prongs are clamped between the fastener and the holding member, and the spring reacts against the supporting member and bears against the retaining portion. The prongs can constitute axially parallel portions of a thin-walled sleeve which is provided with slots alternating with the prongs. The prongs are movable radially of the fastener independently of each other, and at least some of the prongs have end portions which are remote from the retaining portion and include pressure transmitting elements (e.g., in the form of beads) which surround the fastener and bear against the holding member. The pressure transmitting elements can be bent substantially radially outwardly with reference to the remaining portions of the respective prongs, and each such pressure transmitting element has an outer surface which abuts the holding member and an inner surface which is acting upon by the fastener (either directly or indirectly) to urge the outer surface against the holding member, preferably with a force which is a function of the axial position of the fastener with reference to the supporting and holding members, i.e., a function of the extent to which the fastener is appliedto stress the tensioning means. Anti-friction bearing means can be interposed between the pressure transmitting elements and the fastener to facilitate rotation of the fastener in order to couple the holding member to the supporting member or to disengage the holding member from the supporting member.

An annular seal can be installed between the fastener and the holding member. The fastener and the supporting member can define a chamber, and the supporting member can be provided with an air channel which communicates with the chamber. An air channel in the fastener can communicate with a chamber which is defined by the fastener and the holding member.

The holding member can be provided with an exposed portion having a suitablyconfigurated surface, e.g., a surface having a circumferentially complete groove, which facilitates engagement of the holding member by a manipulator, e.g., by a gripper forming part of a tool changer which transfers holding members and their tools between the supporting member and a magazine for tool holding members. For the same purpose, the fastener can be provided with a polygonal head to facilitate engagement of the fastener by a device which rotates the fastener relative to the supporting member so that the fastener can be disengaged from the holding member. A collar of the holding member preferably overlies a portion of the fastener in such a way that the fastener remains accessible for manipulation and can be moved against and thereupon with the holding member, namely to dislodge the holding member with reference to the supporting member.

The supporting and holding members are preferably provided with complementary conical centering surfaces which are biased against each other by the fastener through the medium of the tensioning means. The axial length of at least one of these conical surfaces is preferably a small fraction of the smallest diameter of the respective conical surface, i.e., the cones are relatively short cones so that they do not or need not produce a self-locking action.

The supporting and holding members are preferably further provided with abutting end faces which extend substantially at right angles to the axis of the fastener. Means is preferably provided to monitor the positions of the supporting and holding members relative to each other, and such monitoring means can comprise at least one proximity detector, e.g., a first proximity detector which is recessed into one of the end faces and a second proximity detector in the aforementioned chamber between the fastener and the supporting member.

At least one of the end faces can be provided with at least one projection (e.g., with an annulus of Hirth teeth or with a circumferentially complete rib), and the other end face has one or more complementary recesses for the projection or projections of the one end face.

The novel features which are considered as characteristic of the invention are set forth in particular in the appended claims. The improved mounting itself, however, both as to its construction and the mode of operating the same, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is an axial sectional view of an assembled mounting which embodies the invention and wherein the sections of the holding member clamp a grinding wheel.

DESCRIPTION OF THE PREFERRED EMBODIMENTS

The mounting which is shown in the drawing can be used in a grinding machine to separably couple a rotary grinding wheel 6 to a supporting member in the form of a rotary tool spindle 1 having an annular end face 2 and a hollow axial protuberance 1*a* extending forwardly beyond the end face 2. The end face 2 surrounds a short frustoconical surface 3*a* whose axial length is a small fraction of its minimum diameter and which is surrounded by a complementary frustoconical internal surface 3 of one section 4*a* of a two-piece tool holding member 4 further haing a second section 4*b* cooperating with the section 4*a* to clamp the tool 6 between them. The means for separably securing the sections 4*a*, 4*b* of the holding member 4 to each other comprises a set of screws or bolts 8 which are indicated by phantom lines. The section 4*a* of the holding member 4 has an annular extension or hub 7 which is surrounded by the section 4*b* when the sections 4*a*, 4*b* are properly assembled to hold the radially innermost portion of the grinding wheel 6 between them.

The means for releasably clamping or coupling the holding member 4 to the spindle or supporting member 1 comprises a fastener 9 having an externally threaded shank whose threads mate with the internal threads 12 of the protuberance 1*a*. In accordance with a feature of the invention, the enlarged portion of the fastener 9 urges the rear end face 41 of the section 4*a* of the holding member 4 toward or actually against the end face 2 of the spindle 1 (and thereby enables the conical surfaces 3, 3*a* to center the member 4 and the tool 6 on the spindle 1) through the medium of an elastic tensioning device 11 which is in force- and form-locking engagement with the members 1, 4 as well as with the fastener 9.

The tensioning device 11 comprises an annular retaining portion 13 which spacedly surrounds the shank of the fastener 9 and is received in the axial bore or hole of the extension 1*a* of the spindle 1, a compression spring 17 which is disposed at one side of the retaining portion 13, whose left-hand end portion 17*a* reacts against the adjacent internal shoulder of the protuberance 1*a*, and whose right-hand end portion bears upon or is integral with the retaining portion 13, and a plurality of radially movable elastic prongs 14 which are disposed at the other side of the retaining portion 13 and have radially outwardly bent free end portions provided with pressure transmitting elements 16 in the form of beads having outer surfaces 34 abutting a complementary conical internal surface 32 of the extension 7 of section 4*a* of the holding member 4, and inner surfaces 36 engaging the single race of an antifriction bearing 19. The spherical rolling elements 19*a* of the bearing 19 engage a boss 18 which is or can be an integral part of the fastener 9 and constitutes the inner race of the bearing. The prongs 14 together form a relatively thin metallic or plastic sleeve whose parts are held together by the annular retaining portion 13 and wherein the neighboring prongs are separated from each other by axially parallel slots.

The extension 7 of section 4*a* of the holding member 4 has an internal groove 23 for a ring-shaped seal 22 with a radially inwardly extending sealing lip 22*a* which engages the peripheral surface of a second cylindrical portion or boss 21 of the fastener 9. The purpose of the seal 22 is to prevent penetration of contaminants into the annular chamber which surrounds the fastener 9 and is surrounded in part by the protuberance 1*a* of the spindle 1 and in part by the extension 7 of section 4*a* of the holding member 4.

The main portion of the spindle 1 is formed with an axially extending channel 24 which serves to supply a curtain of blocking air into a chamber 39 between the shank of the fastener 9 and the bottom surface in the axial bore of the protuberance 1*a*. A second axial channel 26*a* is provided in the fastener 9 and communicates with the chamber 39 as well as with radial channels 26*b* to admit air into the annular chamber for the prongs 14 of the tensioning device 11. Such air also blocks the penetration of contaminants into the improved mounting and can clean the conical surfaces 3, 3*a* during separation of the holding member 4 from the spindle 1 as well as during coupling of the illustrated holding member or another holding member to the spindle. Compressed air which is admitted via channels 24 and 26*a*–26*b* can also serve to remove impurities from the end faces 2 and 41 of the members 1 and 4.

The head 27 of the fastener 9 has a polygonal (e.g., hexagonal) peripheral surface which can be engaged by a suitable tool serving to separate the shank of the fastener 9 from the protuberance 1*a* of the spindle 1 or to drive the shank of the fastener 9 into the protuberance. The external surface of the exposed portion of the extension 7 of section 4*a* of the holding member 4 has a circumferentially complete groove 28 which facilitates engagement of the holding member 4 by a suitable manipulator, e.g., by the claws of an automatic tool changer which is used to transport the holding member 4 and the tool 6 thereon between the spindle 1 and a tool magazine, not shown. Reference may be had to commonly owned U.S. Pat. No. 4,528,743 which discloses an automatic tool changer for grinding tools and the like.

If the holding member 4 is to be replaced with a holding member which supports a different tool, the fastener 9 is rotated in a direction to move it axially to the right, as seen in the drawing, so that the front end face 29 of its portion 21 moves into abutment with the inwardly extending annular portion or collar 31 of the section 4*a* of the holding member 4. This enables the bearing 19 to relax the pressure upon the pressure transmitting elements 16 of the prongs 14 so that the elements 16 can move away from the adjacent conical internal surface 32 of the section 4*a*. The elements 16 have a tendency to move radially inwardly, i.e., the prongs 14 are maintained in prestressed condition when the tensioning device 11 is held in the position which is shown in the drawing. As the fastener 9 continues to rotate in a direction to move its head 27 axially and away from the protuberance 1*a* of the spindle 1, the end face 29 bears against the portion 31 and causes the holding member 4 to move off the protuberance 1*a*, i.e., the conical surface 3 becomes separated from the conical surface 3*a* and the end face 41 moves away from the end face 2. The compression spring 17 (which is normally maintained in axially stressed condition) is free to dissipate energy and pushes the retaining portion 13 of the device 11 against a stop 33 in the form of a split ring which is installed in a groove machined into the internal surface of the protuberance 1*a*. At such time, the holding member 4 and its tool 6 can be separated from the spindle 1 while the fastener 9 continues to mate with the protuberance 1*a*. The maximum-diameter portion 21 of the fastener 9 has a diameter which is somewhat smaller than the diameter of the cylindrical internal surface of the section 4*a* to the left of the conical internal surface 32 so that the section 4*a* can be slipped over the fastener 9 on its way away from the end face 2 of the spindle 1.

When a different or fresh holding member 4 (which carries a different tool 6) is to be attached to the spindle 1, the fresh holding member is slipped onto the protuberance 1*a* so that the annular race of the bearing 19 on the fresh holding member moves adjacent the elements 16 of the prongs 14. The operator or a robot then rotates the fastener 9 in a direction to drive its shank into the protuberance 1*a*. The annular race moves the elements 16 apart and their outer surfaces 34 come into contact with the conical internal surface 32 of the protuberance 1*a*. The spring 17 is rather stiff so that it initially prevents an axial shifting of the entire tensioning device 11, i.e., of the annular retaining portion 13 and of the prongs 14. However, the spring 17 begins to yield when the elements 16 engage the conical surface 32 of the protuberance 1*a* and the fastener 9 continues to move in a direction to the left. At such time, each element 16 is clamped between the internal surface 32 of the section 4*a* of the fresh holding member 4 and the race of the bearing 19 in the fresh holding member. Such further axial movement of the fastener 9 causes the end face 41 of the fresh holding member 4 to move toward the end face 2 of the spindle 1. An important advantage of the bearing 19 is that it reduces torsional stresses upon the prongs 14 during application of the fastener 9 because the annular race of this bearing does not turn; the rolling elements 19*a* enable the fastener 9 to turn relative to the annular race.

A proximity detector 37 in a recess of the end face 2 of the spindle 1 is used to monitor the distance a from its sensor to the end face 41 of the newly attached fresh holding member 4. Analogously, a proximity detector 38 in the chamber 39 between the bottom surface in the axial recess of the protuberance 1*a* and the front end face of the fastener 9 monitors the distance b between its sensor and the fastener. These detectors generate signals which are noted by the operator and/or by the control system which serves to regulate tightening of the fastener 9.

As a rule, the holding members 4 and their tools 6 will be replaced by automatic tool changing mechanisms. A gripper of the mechanism which is used to carry out the change engages the external surface of the section 4*a* in the region of the groove 28 while an automatic screw driver rotates the fastener 9 by engaging and turning the polygonal head 27, either in a direction to separate a holding member from the spindle 1 or to attach a fresh holding member. Of course, it is equally within the purview of the invention to use manually operated wrenches, screw drivers and analogous tools to replace the holding member 4 with a fresh holding member.

If desired, at least one of the end faces 2, 41 can be provided with torque transmitting projections in the form of Hirth type teeth or the like, and the other of these end faces has recesses for the projections. Hirth type teeth further allow for an accurate angular adjustment of the holding member 4 and spindle relative to each other, i.e., one and the same holding member 4 can be repeatedly located in a predetermined angular position with reference to the spindle 1. It is also possible with provide mating tooth-like or otherwise configurated projections on each of the end faces 2 and 41.

An important advantage of the improved mounting is its simplicity and sturdiness. Moreover, the wear on the parts of the mounting is practically nil because all of its components rotate as a unit as soon as the holding member 4 is properly affixed to the spindle 1. The detector 37 and/or 38 generates a signal when the axial position of the holding member 4 relative to the spindle 1 deviates from an optimum position.

Another important advantage of the improved mounting is that it can be manipulated by hand (i.e., by manually held tools) or by a fully automated tool changing mechanisms.

It is further within the purview of the invention to replace the relatively short conical surfaces 3 and 3*a* with longer conical surfaces which can produce at least some self-locking action. Reference may be had to the aforementioned commonly owned copending U.S. patent application Ser. No. 891,539.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and areintended to be comprehended within the meaning and range of equivalence of the appended claims.

We claim:

1. In a machine, particularly in a grinding machine, a mounting for rotary tools comprising a rotary supporting member; a rotary tool holding member; means for separably coupling said members to each other with a variable force, including a threaded fastener coaxial with said members and mating with said supporting member; and resilient tensioning means form- and force-lockingly installed between said tool holding member and said coupling means, said tensioning means concentrically surrounding said fastener and being elastic in the axial and radial directions of said fastener.

2. The mounting of claim 1, further comprising an annular seal between said fastener and said holding member.

3. The mounting of claim 1, wherein said holding member has an exposed portion provided with a surface which facilitates engagement of said holding member by a manipulator.

4. The mounting of claim 1, wherein said fastener has a polygonal head.

5. The mounting of claim 1, wherein said holding member has a collar overlying a portion of said fastener.

6. The mounting of claim 1, wherein said members have abutting end faces extending substantially at right angles to the axis of said supporting member.

7. In a machine, particularly in a grinding machine, a mounting for rotary tools comprising a rotary supporting member; a rotary tool holding member; means for separably coupling said members to each other with a variable force, including a threaded fastener coaxial with said members and mating with said supporting member; and resilient tensioning means form- and force-lockingly installed between said tool holding member and said fastener, said tensioning means including an annular retaining portion, a plurality of radially movable elastic prongs at one side of said retaining portion, and a spring disposed at the other side of said retaining portion and being yieldable in the axial direction of said fastener.

8. The mounting of claim 7, wherein said retaining portion surrounds said fastener and said prongs are clamped between said fastener and said holding member, said spring reacting against said supporting member and bearing against said retaining portion.

9. The mounting of claim 7, wherein said prongs together form a thin-walled sleeve having slots between neighboring prongs.

10. The mounting of claim 7, wherein said spring is a compression spring.

11. The mounting of claim 7, wherein said prongs are movable radially of said fastener independently of each other and at least some of said prongs have free end portions remote from said retaining portion and including pressure transmitting elements surrounding said fastener and bearing against said holding member.

12. The mounting of claim 11, wherein said elements are bent substantially radially outwardly and each thereof has an outer surface abutting said holding member and an inner surface which is acted upon by said fastener to urge the outer surface against said holding member with a force which is a function of the axial position of said fastener with reference to said members.

13. The mounting of claim 12, further comprising antifriction bearing means interposed between said elements and said fastener.

14. In a machine, particularly in a grinding machine, a mounting for rotary tools comprising a rotary supporting member having an air conveying channel; a rotary tool holding member; means for separably coupling said members to each other with a variable force, including a threaded fastener coaxial with said members, said supporting member and said fastener defining a chamber which communicates with said channel; and resilient tensioning means form- and force-lockingly installed between one of said members and said coupling means.

15. In a machine, particularly in a grinding machine, a mounting for rotary tools comprising a rotary supporting member; a rotary tool holding member; means for separably coupling said members to each other with a variable force, including a threaded fastener coaxial with said members, said fastener having an air-conveying channel and said fastener and at least one of said members defining a chamber which communicates with said channel; and resilient tensioning means form- and force-lockingly installed between one of said members and said coupling means.

16. In a machine, particularly in a grinding machine, a mounting for rotary tools comprising a rotary supporting member; a rotary tool holding member; means for separably coupling said members to each other with a variable force, including a threaded fastener coaxial with said members and mating with said supporting member, said members having complementary conical surfaces which are biased against each other by said fastener; and resilient tensioning means form- and force-lockingly installed between said tool holding member and said fastener.

17. The mounting of claim 16, wherein the axial length of said conical surfaces is a fraction of the minimum diameter of said surfaces.

18. In a machine, particularly in a grinding machine, a mounting for rotary tools comprising a rotary supporting member; a rotary tool holding member; means for separably coupling said members to each other with a variable force, including a threaded fastener coaxial with said members and mating with said supporting member; resilient tensioning means form- and force-lockingly installed between said tool holding member and said fastener; and means for monitoring the action of said tensioning means.

19. The mounting of claim 18, wherein said monitoring means includes at least one proximity detector.

20. The mounting of claim 19, wherein said members have neighboring end faces and said proximity detector is recessed into one of said end faces.

21. The mounting of claim 19, wherein said fastener and one of said members define a chamber and said proximity detector is disposed in said chamber.

22. In a machine, particularly in a grinding machine, a mounting for rotary tools comprising a rotary supporting member; a rotary tool holding member, said members having neighboring end faces and at least one of said end faces having at least one projection, the other of said end faces having a recess for said projection; means for separably coupling said members to each other with a variable force, including a threaded fastener coaxial with said members and mating with said supporting member; and resilient tensioning means form- and force-lockingly installed between said tool holding member and said fastener.

* * * * *